United States Patent [19]

Kümmerlin et al.

[11] Patent Number: 4,502,564

[45] Date of Patent: Mar. 5, 1985

[54] STEPLADDER

[76] Inventors: Walter Kümmerlin, In den Fressäckern 6, D-7120 Bietigheim-Bissingen; Nikolaus A. Kümmerlin, Humboldtstrasse 26, D-7730 VS-Schwenningen, both of Fed. Rep. of Germany

[21] Appl. No.: 480,165

[22] Filed: Mar. 29, 1983

[30] Foreign Application Priority Data

| | | | |
|---|---|---|---|
| Apr. 6, 1982 | [DE] | Fed. Rep. of Germany | 3212847 |
| Oct. 5, 1982 | [DE] | Fed. Rep. of Germany | 3236781 |
| Nov. 4, 1982 | [DE] | Fed. Rep. of Germany | 3240682 |

[51] Int. Cl.[3] ..... E06C 1/387

[52] U.S. Cl. ..... 182/161; 182/165

[58] Field of Search ..... 182/159, 156, 161, 162, 182/165, 175

[56] References Cited

U.S. PATENT DOCUMENTS

| | | | |
|---|---|---|---|
| 104,569 | 6/1870 | Floyd | 182/156 |
| 1,153,558 | 9/1915 | Matheny | 182/156 |
| 2,952,301 | 9/1960 | Schlaak | 182/156 |
| 2,975,856 | 3/1961 | Anderson | 182/161 |
| 4,421,206 | 12/1983 | Kummerlin | 182/156 |

FOREIGN PATENT DOCUMENTS

| | | | |
|---|---|---|---|
| 2613142 | 10/1977 | Fed. Rep. of Germany | 182/156 |
| 2718341 | 10/1978 | Fed. Rep. of Germany . | |
| 454605 | 5/1913 | France | 182/161 |
| 614373 | 9/1926 | France | 182/161 |
| 330282 | 10/1935 | Italy | 182/156 |
| 21304 | of 1891 | United Kingdom | 182/156 |
| 1547243 | 6/1979 | United Kingdom . | |

*Primary Examiner*—Reinaldo P. Machado
*Attorney, Agent, or Firm*—Martin A. Farber

[57] ABSTRACT

A stepladder having a pair of legs and two or more steps wherein the steps are pivoted to one of the legs and to guide members. Each of the legs includes a pair of side members. The guide members are spaced from and parallel to the side members of the first leg. When the ladder is in a position of use a latching device locks the second leg and the guide members together and helps transmit a load on the steps to the second leg. When the ladder is in a transport position the tread surface of the steps is disposed in a plane that is common to the plane formed by a rear surface of the second legs. The pivot connections between the steps and the first and second legs and the dimensions therebetween assure the same security in using the stepladder as is obtained by using fixed steps.

24 Claims, 9 Drawing Figures

STEPLADDER

The present invention relates to a stepladder, the two legs of which are swingably attached to each other.

It has already been proposed for stepladders of this type that the depth of the plate-shaped steps, the difference in height between two successive steps, as well as the stagger of the steps with respect to each other be so selected that in using the stepladder those conditions which are present in the case of fixed steps are likewise present in the stepladder. Such conditions will enable one to stand just as securely on a stepladder as on a fixed staircase and also permit use of the stepladder just as safely as a stationary staircase with one's face or back towards the ladder without having to search for additional security that might be available by holding on to something with one's hand. With such a stepladder, however, it is not possible to obtain an optimum relationship between the dimensions of the ladder in its transport position, i.e. with the legs placed parallel to each other, and the height which can be obtained in the position of use, i.e. with the maximum spread of the legs. Furthermore, the handling of this stepladder, particularly when converting it from the transport position into the position for use and vice versa, is not as convenient as would be desirable.

A first object of the invention is to develop a stepladder that affords greater security in use. Another object of the invention is a stepladder which, although it is as safe and convenient as a stationary staircase, has a more favorable relationship between its dimensions in its transport position and the height which can be obtained with the ladder by a user. In particular, in a stepladder having only two steps in which the tread of the upper step in the position of use is at least 40 cm above the surface on which the ladder is standing, both the height and the width in the transportation position are to be less than 60 cm and, in the case of a ladder having three steps and a height of the tread of the uppermost step in the position of use of at least 60 cm above the surface on which the ladder is standing, the height or length in the transport position is to be less than 80 cm so that the two step ladder can be stored even in a bottom cabinet and the three step ladder can be stored below the work surface of, for example, an article of kitchen furniture.

Another object of the invention is a stepladder of maximum stability. Since the stability can be increased by spreading apart the side the side-pieces of at least one of the two legs towards their lower end, which results in a complicated construction in the case of the known stepladders, another object of the invention is a stepladder which is of simple construction even with legs having side-pieces that spread apart.

Finally, another object of the invention is a stepladder the handling of which, when converting from transport position into the position of use and vice versa, is particularly convenient.

With the above and other objects and advantages in view, the present invention will become more clearly understood in connection with the detailed description of preferred embodiments, when considered with the accompanying drawings, of which:

Figure 4:
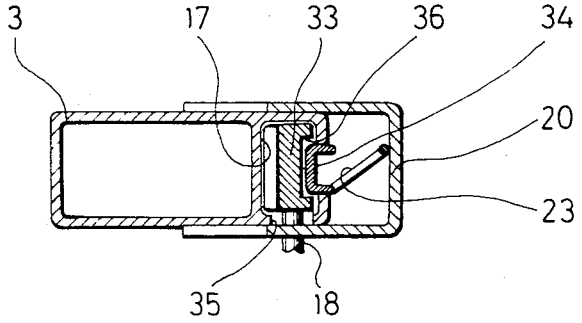
FIG. 4 is a sectional view taken on the line IV—IV of FIG. 3.

A first leg 1 of a stepladder is swingably attached in the region of its upper end with the upper end of a second leg 2. The second leg 2 consists of two side pieces 3 which are mirror images of each other and are arranged parallel to and spaced from each other, and of a plate-shaped spacer 4. The side members 3 are shaped aluminum tubes having a cross-section which consists of a rectangular tube and a C section adjoining the narrow side thereof, as shown in FIG. 4. The C-section is open towards the other side member 3 and with its one leg forms the outer side of said side member, onto which outer side the plate-shaped spacer 4 is riveted in the lower end section. Plastic parts 5 and 6 form caps on the upper and lower ends respectively of the side members 3. The plastic parts 6 furthermore form a slide-resistant foot as shown, for instance, in FIG. 1.

Figure 1:
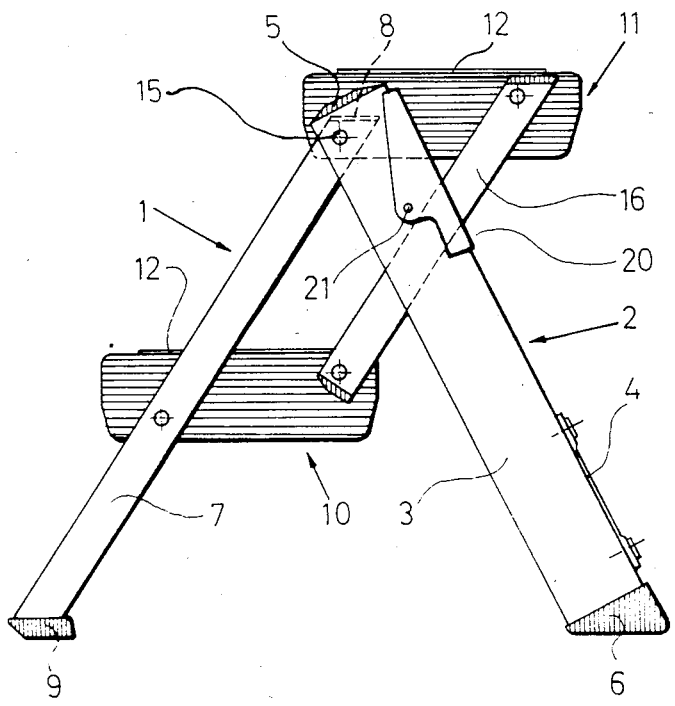
FIG. 1 is a side view of a stepladder, in a position of use incorporating one embodiment of the present invention.
Figure 5:
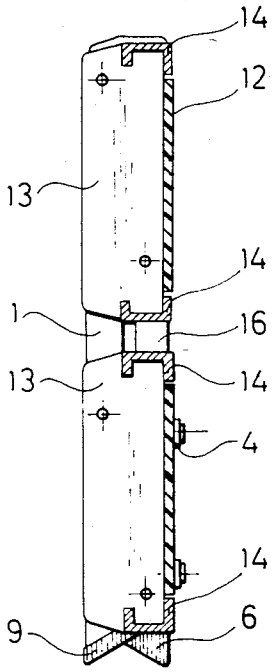
FIG. 5 is a sectional view corresponding to FIG. 2, showing the ladder in the transport position.

The first leg 1 also consists of two side members 7 which are parallel to and spaced apart from each other, having their upper ends engaged between the two side members 3 of the side leg and, therefore, in transport position, lie over their entire length between said side members 3 and parallel to them, as shown in FIG. 5. Each of the two side members 7 consists of a square aluminum tube whose width, measured in the direction of swing, is somewhat less than half of the corresponding width of the side member 3 in that direction. The upper and lower ends of the two side members 7 are closed by plastic parts 8 and 9 respectively, the latter plastic part forming a skid-proof foot, as shown in FIG. 1. The length of the side members 7, including the plastic parts 8 and 9, is 49 cm as is the length of the side members 3 including the plastic parts 5 and 6 shown in the embodiment, this being equal to the transportation height. In transport position the ladder, therefore, stands vertically even without lateral support, since the plastic parts 6 and 9 of the first and second legs engage the ground.

The ladder has plate-shaped supports comprising a lower step 10 and an upper step 11 both of which are made of aluminum plate and form a tread, having a tread depth of 23 cm and a width of 36 cm. A rubber mat 12 bonded onto the tread provides a very high degree of assurance against slipping. The steps 10 and 11 have side cheeks 13 extending downward at a right angle from the tread as well as a front and a rear wall 14 which is bent off inwards at an angle at a distance from the tread so as to form in each case a gripping ledge by which the ladder can be conveniently gripped by hand.

At a distance of 3 cm from the front wall 14, the upper step 11 is swingably attached by a tube 15 to the two side members 7. This tube 15 also connects the legs 1 and 2 together. The distance of the center of the opening in the side cheeks 13 for the passage of the tube 15 from the top of the rubber mat 12 is selected equal to the distance of the pivot axis formed by the tube 15 from the side of the side member 3 serving as a resting surface for the spacer 4. Thus when the ladder is in the transport position, the top side of the rubber mat 12 lies in the plane defined by this side of the side members 3 and therefore does not protrude beyond that side. In the position of use of the ladder shown in FIGS. 1 and 2, and in accordance with the selected length of the side members 3 and 7, the top of the rubber mat 12 is 46 cm above the floor.

The lower step 10 is pivoted to the side member 7 at such a height that the top of its rubber mat 12 is 23 cm above the floor in the position of use of the ladder. As a pivot pin there is also used a tube which passes through the side cheeks 13 of the lower step 11 and is fixed in the side members 7, plastic parts being present between the side cheeks 13 as spacers, in the same way as in the case of the upper step 11. Other parts close off the ends of these tubes which serve as pivot shafts.

Figure 2:
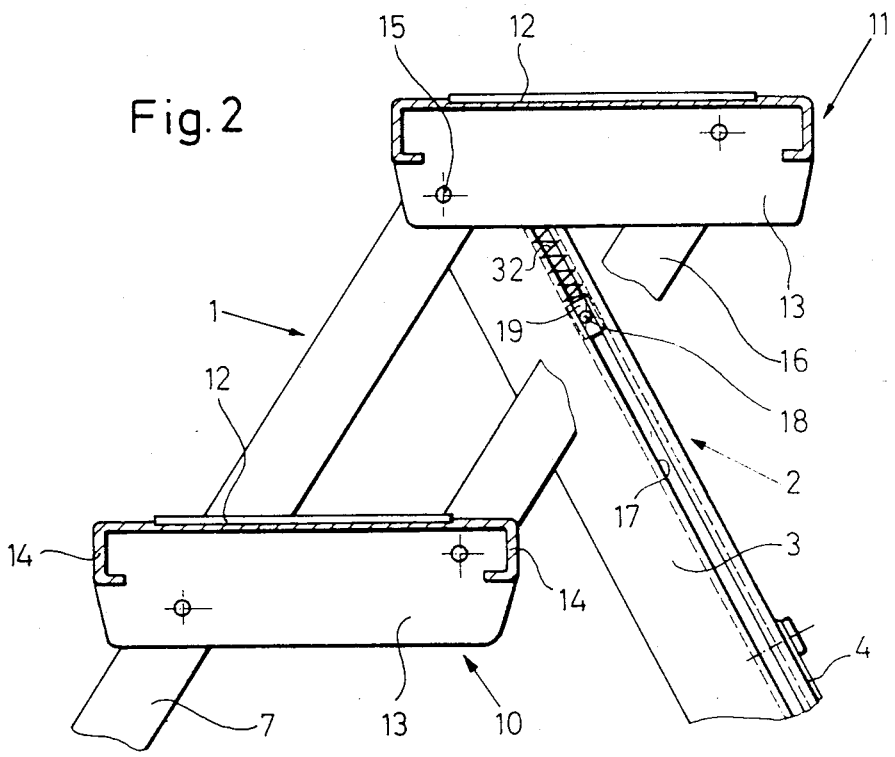
FIG. 2 is an enlarged fragmentary cross-section, thereof in the position of use.

As shown in FIG. 2, the center of the opening in the side cheeks 13 of the lower step 11 for the tube which serves as pivot shaft is at a distance from the front wall 14 which is greater than the corresponding distance in the case of the upper step 11. In the embodiment shown this distance is preferably 5 cm. In this way the lower step 10 has a relatively large projection beyond the front side of the side member 7 which faces the user. Thus the user, by placing a load on the front edge of the lower step 10, exerts a moment of rotation in counterclockwise direction as seen in FIG. 2. The distance of the center of the tube serving as the pivot shaft from the top of the rubber mat of the lower step 10 is selected in such a manner that the top of the rubber mat 12, in transport position, lies in the same plane as the top of the rubber mat of the upper step 11, and thus does not protrude beyond the side members 3 as shown in FIG. 5. The two steps 10 and 11, towards their rear edges are pivotally connected to two guide members 16 which lie in the plane of swing of the respective two side members 7 of the first leg and, like those side members 7, are made of square aluminum tubing which, for example, has the same profile as the side members 7. The connection of the steps 10 and 11 to the guide members 16 is effected in the same way as their connection to the side members 7, i.e. by means of one tube for each step. Plastic parts close off the ends of these tubes and serve as spacers between the side cheeks 13 and the guide members 16. The center of the connection between the lower step 10 and the guide members 16 lies—as shown in FIG. 1—vertically below the center of the shaft which connects the two legs 1 and 2 to each other. Furthermore, the center of connection is arranged at a distance from the top of the rubber mat 12 of the lower step 10 such that, in the transport position, the guide members 16 lie alongside and parallel to the respective two side members 7 and at a slight distance from the side members 7, and the guide members 16 as well as the steps 10 and 11 protrude beyond the side of the side members 3 which bear the spacer 4. This relationship also applies to the position of the center of the articulated connection between the guide members 16 and the upper step 11 with respect to its rubber mat. On the other hand, the distance between this center and the rear wall 14 is greater in the case of the upper step 11 than in the case of the lower step 10.

A steel pin 18 is fastened to each of the two guide members 16 at the place where they intersect a guide groove 17 of the adjacent side member 3 which is formed by the C section. The pin 18 of one guide member 16 is aligned wth the pin 18 of the other guide member 16. The two pins 18 lie parallel to the shafts which connect the legs 1 and 2 as well as the steps 10 and 11 with the side members 7 and the pins 18 pass through the respective guide member 16 with which they are associated. The projection of the inside head of the pin 18 is so slight in the case of both pins 18 that the swinging movement of the two steps 10 and 11 into the transport position is not impaired by these two heads. On the other hand, the projection of the two pins 18 towards the outside is sufficiently great that they engage in respective slide blocks 19. The two identically developed slide blocks 19 are adapted to the shape of the guide grooves 17 of the respective side members 3 which receive them and are displaceable in the longitudinal direction of the guide groove 17. Between each of the two guide members 16 and the corresponding side members 3 of the second leg 2 a slot-pin guidance system is therefore present.

Each slide block 19 has, at its upper end, a slightly conical projection 31 which as centering member extends into the lower end of a coil compression spring 32, the lowermost turn of which rests against the corresponding slide block 19. As an upper spring stop provided to support the upper end of the spring 32 there is provided for each side member 3 a plastic plug 33 which conforms in shape to the C section of the guide groove 17 and is seated in the latter. At its lower end the plug 33 has a protruding pin 37, to which the upper end of the spring 32 is fastened. This is done in the manner that the uppermost turn of the spring 32 engages into an annular groove in the pin 37. The plug 33 is secured in the guide groove 17 by the bent end 34 of the one leg of a hairpin spring 23, the further function of which will be explained below when describing the construction of the locking means for the pins 18. As can be noted from FIG. 4, the spring end 34 passes through a slot in the wall of the slide member 3 which extends into the inside of the guide groove 17, the end 34 of the spring engaging into a groove 36 which is formed in the plug 33 in order to secure the plug 33 against displacement within the guide groove 17.

If the diameter of the compression springs 32 is greater than the inside width of the longitudinally extending opening 35 (FIG. 4) of the C section of the guide grooves 17, the compression springs need not be fastened on the pin 37 of the plug 33 but could be inserted loosely into the corresponding guide groove 17. The introduction of the compression springs 32 is in this case effected from the upper open end of the guide groove 17 before the groove is closed by the closure plug 33 and the plastic part 5.

In order to lock the two pins 18 in form-locking manner in the position they occupy when the stepladder is in the position of use shown in FIGS. 1 and 2, there is associated with each of these two pins 18 a locking device which, in the locked position, prevents in form-locked manner displacement of the pin 18 in the longitudinal direction of the guide groove 17. Therefore the two guide members 16 in the position of use of the ladder rest in form-locked manner on the two side members 3 and thus transmit a part of the load exerted on the steps by a person using the ladder into the side members 3. The side members 7 are therefore relieved of stress by the guide members 16.

Figure 3:
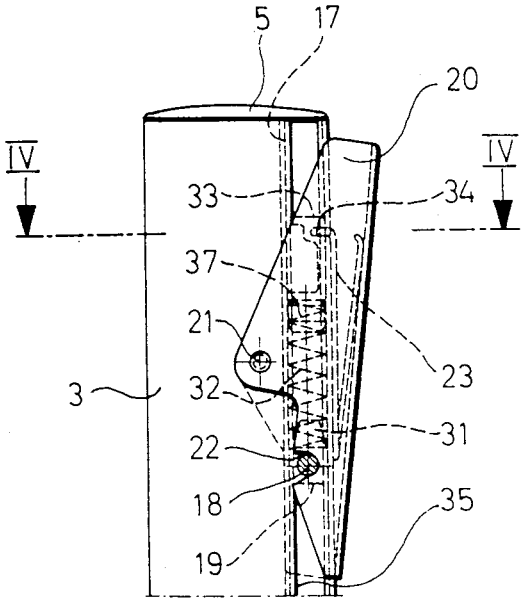
FIG. 3 shows the inner side of a locking device used thereon.

In the embodiment shown, for example, each of the two locking devices is formed by a latch 20. The two latches 20, which are identical mirror images of each other, consist of a U-rail which is placed on the associated side member 3 from the side thereof serving as support for the spacer 4. In this connection there is only slightly clearance between the legs of the latch 20 and the side member 3. As shown in particular in FIG. 3, the height of these legs of the latch 20 at first increases from the upper end of the latch 20 towards the lower end to such an extent that a swivel pin 21 can pass through these legs of the latch 20 as well as the rectangular tube section of the side member 3. Towards the lower end of the latch 20 the section with increasing height of leg is followed by a section of smaller height of leg. In this section the inner leg has a notch 22 which in the locking position of the latch 20 receives the associated pin 18 in form-locked manner while it releases it in the unlocked position. By means of a run-on bevel between the notch 22 and the adjacent free end of the latch 20 assurance is had that the pin 18 will, upon the spreading apart of the two legs 1 and 2, swing the part of the latch 20 which protrudes into its path of movement away to such an extent that it drops into the notch 22. The latch 20 is under the force of the pretensioned hairpin spring 23 which attempts to hold it in the locked position. The leg of this spring 23 which has the bent end 34 rests against the side of the side member 3 which bears the spacer 4, while the other spring leg of the spring extends in the longitudinal direction of the side member towards the upper end of the latch 20 where it rests against the yoke part of said latch and therefore exerts a moment of rotation in clockwise direction as seen in FIG. 3 on the latch 20. The leg of the latch 20 which rests against the outside of the side member 3 has, for example, also a section of reduced height of leg adjoining the section of increasing height of leg. This leg could, however, also be developed in some other manner. The sole condition is that the leg of the latch 20 be capable of bearing the swivel shaft 21 and that the distance between the yoke section of the latch 20 in the region of its upper end and the side of the side member 3 bearing the spacer 4 be sufficiently large so that the tilting movement of the latch 20 upon pressure on the upper end of the latch is sufficient to permit the pin 18 to emerge from the notch 22.

The position of the latch 20 on the side member 3 depends on where the guide members 16 intersect the guide grooves 17. For example, if the angle which the two legs make in the position of use of the ladder is selected in the manner shown in FIG. 1, then the point of intersection can lie at such a slight distance from the upper end of the side members 3 that the upper end of the latch 20 terminates flush with said end of the side member 3.

Figure 6:
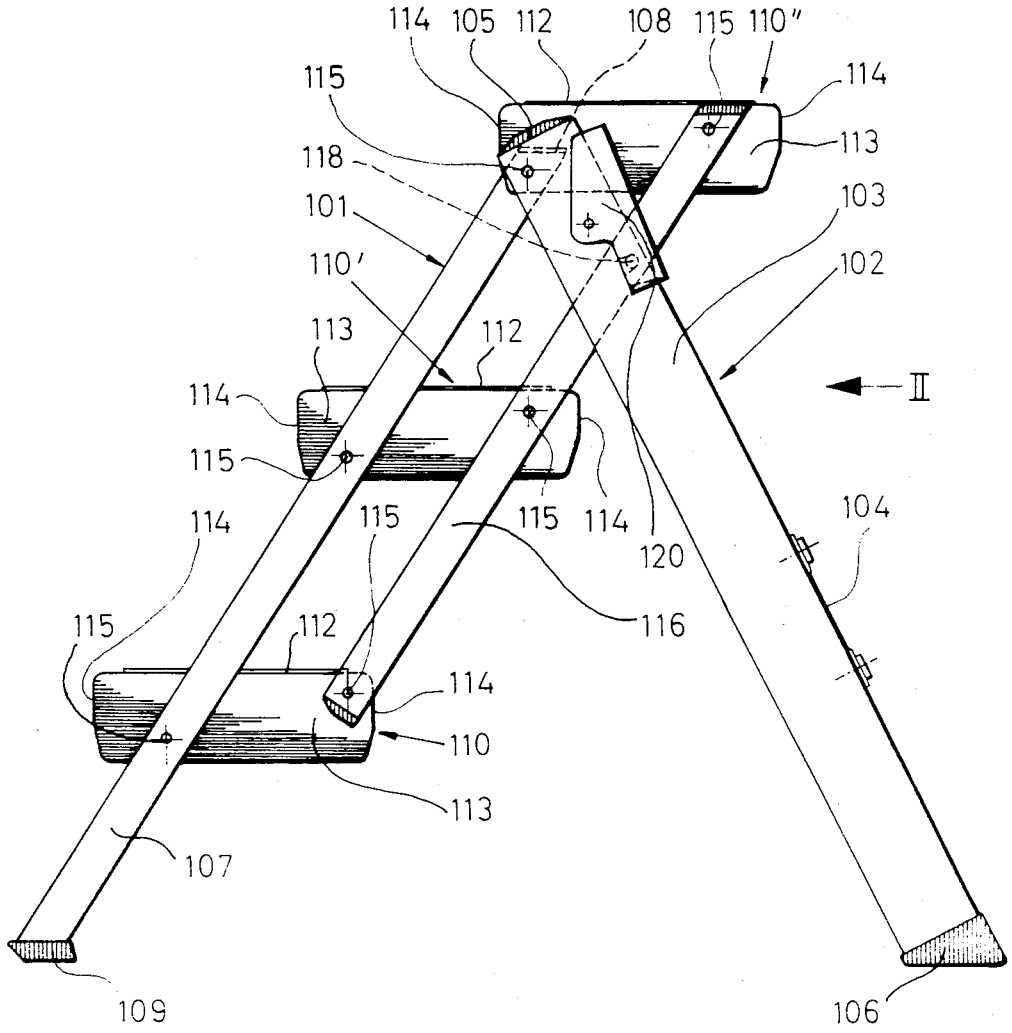
FIG. 6 is a side view of a second embodiment of the invention shown in its position of use.
Figure 7:
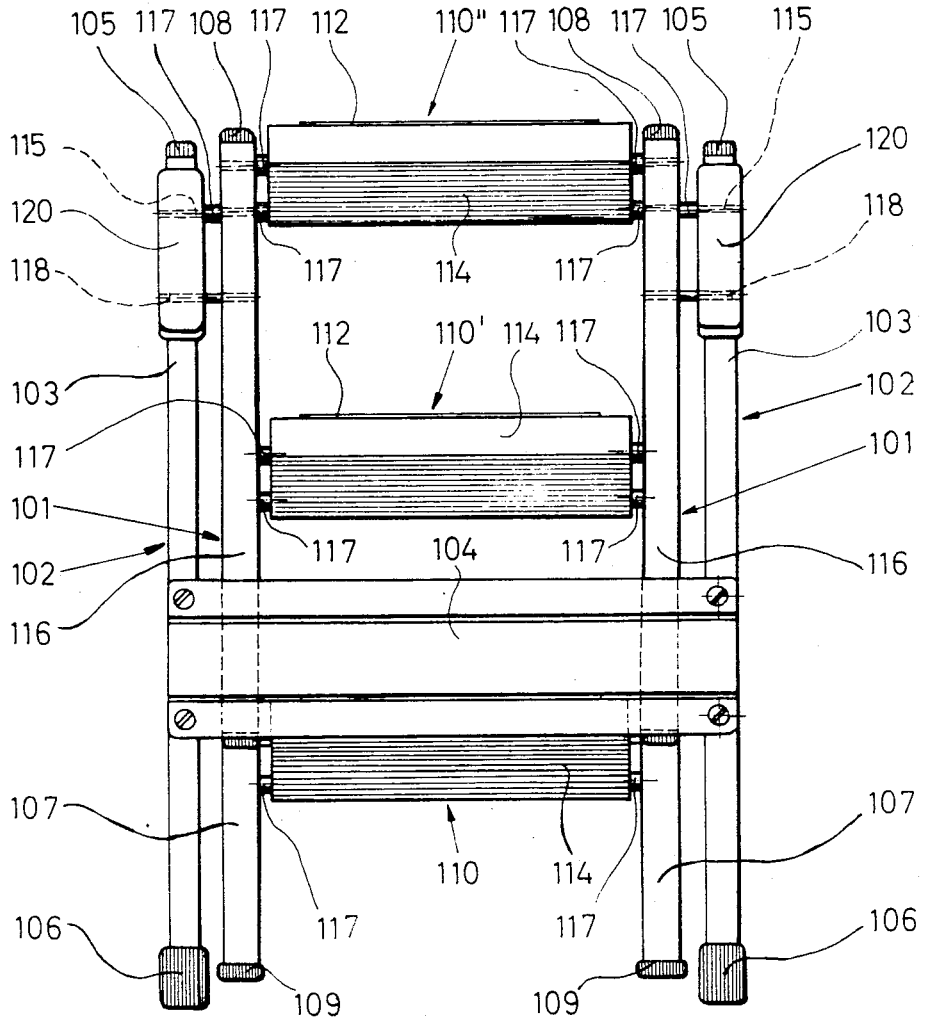
FIG. 7 is a rear view thereof taken in the direction of the arrow II of FIG. 6.

In order to bring the ladder from the position of use shown in FIG. 1 into the transport position of FIG. 5, it is merely necessary to actuate the two latches 20. As soon as the pins 18 then emerge from the notch 22 in the latch 20, the compression springs 32 whose spring force acts on the slide blocks 19 displace the slide blocks 19 together with the associated pins 18 downwards in the guide grooves 17. This movement produces a moment of rotation in the direction towards swinging the spread legs 1 and 2 together. Since the movement of displacement of the pins 18 produced by the force of the springs 32 moves the pins 18 out of the region of the notch 22 as soon as the latches 20 are moved in the direction of unlocking, the user, after actuating the latches 20, can immediately release the latches 20 again without having to fear that the pins 18 will again lock under the action of the hairpin springs 23 which act as locking springs. If the ladder is to be brought from the transport position into the position of use, it is merely necessary to spread the collapsed legs 1 and 2 apart. This can be done, for instance, by grasping the downward-facing back wall 14 of the step 11 with one hand and the upward-pointing front wall with the other hand and swinging said step into the horizontal position. In this way the two legs 1 and 2 are spread apart and the lower step is also swung into the position of use. If, in this connection, the two pins 18 should not be moved so far upward that they engage in the notches 22 since the compression springs 32 are increasingly tensioned during the spread-swing movement then a slight exertion of load on the front edge of the lower step 10 is sufficient to reach the position of maximum spread of the two legs 1 and 2, in which position the pins 18 are directed towards the notches 22 so that the locking is produced automatically under the influence of the springs 23 of the latches 20. A first leg 101 of a second embodiment is swingably attached in the region of its upper end to the upper end of the second leg 102. The second leg 102 consists of two side members 103, developed as mirror images of each other, as well as a plate-shaped spacer 104. In the embodiment shown in FIGS. 6 and 7, the side members of both legs 101 and 102 extend in vertical planes which are parallel to each other, as shown in FIG. 7. The side members 103 are shaped aluminum tubes having a cross-sectional profile which consists of a rectangular tube and a C shape adjoining the one narrow side such as shown in FIG. 4. The C shape is open towards the other cross member 103 and with its one leg forms the outside of said cross member, the plate-shaped spacer 104 being riveted onto said outer side in the lower end section. Plastic parts 105 and 106 close off the upper and lower ends respectively of the cross members 103. The plastic parts 106 furthermore form a skid-free foot, as shown in FIG. 6.

The first leg 101 also consists of two side members 107 which are arranged parallel to and spaced apart from each other, the upper end thereof engaging between the two side members 103 of the second leg and therefore lying between said side members 103 and parallel thereto over their entire length in the transport position. Each of the two side members 107 consists of a square aluminum tube the width of which, measured in the direction of swing is somewhat less than one-half of the corresponding width of the side members 103 in that direction. The upper and lower ends of the two side members 107 are closed by plastic parts 108 and 109 respectively, the latter forming a skid-proof footrest, shown in FIG. 6. The length of the side members 107 including the plastic parts 108 and 109 amounts, like the length of the side members 103 including the plastic parts 105 and 106 in the embodiment, to 76 cm which is equal to the height upon transportation. In the transport position the ladder stands vertically, even without lateral support.

The ladder has a lower step 110, a middle step 110' and an upper step 110'', the steps consisting of aluminum plate and forming a tread which results in a depth of tread of 23 cm and a width of 36 cm. A rubber mat 112 bonded onto the treat assures a high degree of resistance to slipping. The steps have side cheeks 103 extending downward at a right angle from the tread as well as a front and a rear back wall 114 which is bent downward at an angle at a distance from the tread so as to form a gripping ledge by which the ladder can be conveniently grasped by hand.

The lower step 110 is swingably attached to the two side members 107 by means of a tube 115 at a distance of 6 cm from the front wall, the middle step 110' is connected at a distance of 4 cm away from the front wall 114 and the upper step 110" at a distance of 2 cm away from the front wall 114. The tube 115 which is associated with the uppermost step 110" also connects the legs 101 and 102 swingably to each other. The distance of the center of the opening in the side cheeks 113 for the passage of the tube 115 from the top of the rubber mat 112 is equal to the distance between the angle of swing formed by the tube 115 and the side of the side members 103 serve as a resting surface for the spacer 104. Thus in the transport position, the top of the rubber mat 112 lies in the plane defined by the side of the side members 103 and therefore does not project beyond this side. In the position of use of the ladder, and in accordance with the selected length of the side members 103 and 107, the top of the rubber mat 112 of the uppermost step is 69 cm above the surface on which the ladder is standing.

The lower side of the step 110 is pivoted at such a height to the side members 107 that the top of its rubber mat 112 is 23 cm above the floor in the position of use of the ladder. As in the case of the other steps, plastic sleeves 117 placed over the tubes 115 serve as spacers between the side cheeks 113 and the side members 107. Other plastic parts close off the ends of the tubes 115 serving as shafts. Plastic sleeve 117 are provided as spacers also at the pivot point between the side members 107 of the arm 101 and the side members 103 of the other arm 102.

By the protrusion of the lowermost step 110 beyond the front side of the side members 107 facing the user, the application of load to the front edge of the lowermost step produces a moment of rotation in counterclockwise direction as seen in FIG. 6. In this way, when the lowermost step is stepped upon, the two legs of the ladder are positively brought into their maximum position of spread if they have not already been brought into this position upon the setting up of the ladder.

Towards their rear edge, the steps 110, 110' and 110" are pivotally connected to two guide members 116 which lie in the plane of swing of the respective side members 107 of the first leg and, like the side members 107, consist of a square aluminum tube which, for example, has the same profile as the side member 107. The connection to the guide members 116 is effected in the same manner as the connection to the side members 107 by, in each case, a tube 115. Plastic parts close off the ends of these tubes and plastic sleeves 117 are provided as spacers between the side cheeks 113 and the guide members 116 in the same way as between the side cheeks 113 and the side members 107. In this embodiment, for example, all plastic sleeves 117 are the same length. The center of the connection between the lowermost step 110 and the guide members 116 has a distance from the rear back wall 114 of 2 cm. The corresponding distance in the case of the middle step 110' is 4 cm and, in the case of the uppermost step 110", 6 cm. The distance of this center from the top of the rubber mat 112 is so selected that, in transport position, the guide members 116 lie alongside the corresponding side members 107, parallel thereto and a slight distance away and do not project beyond the side of the side members 103 which bears the spacer 104.

A steel pin 118 is connected to each of the guide members 116 at the place where they intersect the guide groove formed by the C section in the adjacent side member 103. The pin 118 of the one guide member 116 is aligned with that of the other guide member 116. The two pins 118 lie parallel to the shafts which connect the legs 101, and 102, and the steps 110, 110', and 110" to the side members 103 and pass through the guide member 116 with which they are associated. Each pin 118 engages in a slide block which is inserted in the guide groove in the side member 103 in the manner described for the first embodiment. In order to be able to lock the two pins 118 in form-locked manner in the position which they occupy in the position of use of the stepladder shown in FIGS. 6 and 7, a locking mechanism is associated with each of these pins 118, it, in form-locked manner, preventing displacement of the pin 118 with the slide block in the longitudinal direction of the guide groove in the locked position. For this locking separate latches 120 are provided. The two latches 120, which are mirror images of each other, consist of U rails placed on the associated side member 103 from the side thereof serving as support for the spacer 104. These latches 120, which are swingably attached to the side member, form with their inner legs a notch which in form-locked manner receives the associated pin 118 in the locked position of the latch and releases it in the unlocked position. In this position, the two legs 101 and 102 can be swung together, the steps 110, 110' and 110" carrying out a swinging movement in clockwise direction as seen in FIG. 6 until, with the ladder completely collapsed, they lie without projection between the side members 103 of the leg 102.

Figure 8:
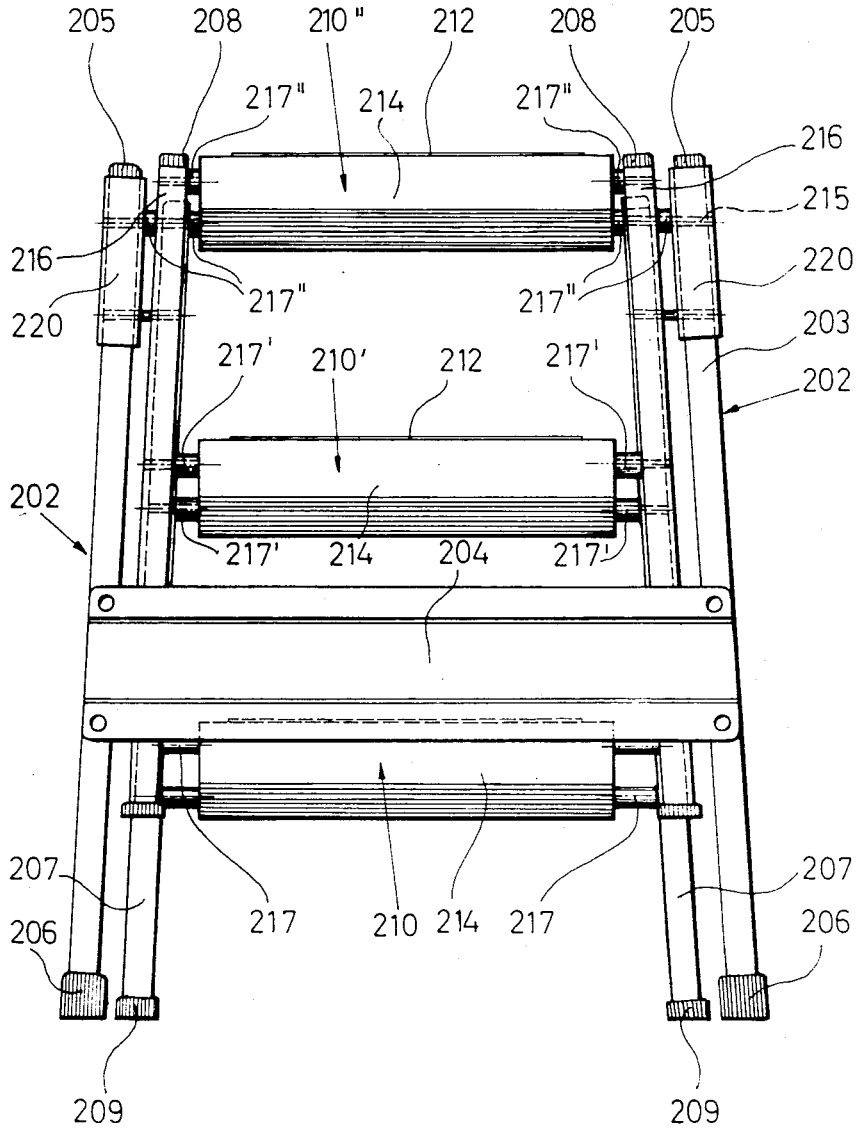
FIG. 8 is a rear view of a third embodiment of the invention, shown in position of use; and, FIG. 9 is a rear view thereof in the transport position.
Figure 9:
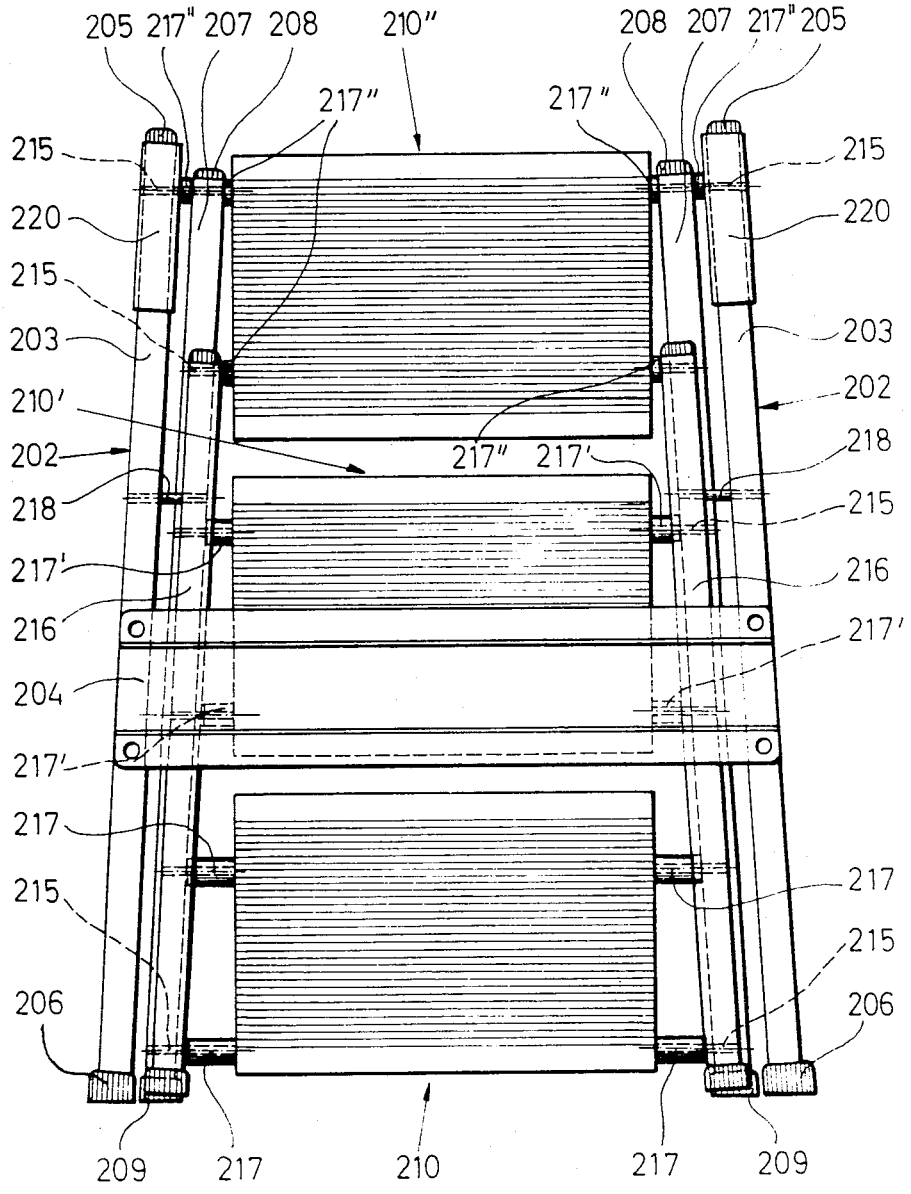

In FIGS. 8 and 9, which show a third embodiment of the stepladder, parts which correspond to parts in the first embodiment are designated with reference numbers which are greater by 100. The embodiment in accordance with FIGS. 8 and 9 differs from the example described above essentially by the fact that the distances between the side members 207 of the one leg, the two side members 203 of the other leg and the two guide members 216 increase from the upper to the lower end of the ladder uniformly and to the same extent. By this lateral spreading of the two legs there is obtained an increase in the width of the standing surface and thus increased stability. The following description of the third embodiment is limited to the differences from the second embodiment. In order to avoid repetition, reference is furthermore had to the explanations given with regard to the second embodiment, which to this extent also apply to the third embodiment.

Upon comparison of FIG. 8, which shows the ladder in the opened position of use, with FIG. 9, which shows the ladder in the collapsed transport position, it can be seen that in the transport position (FIG. 9) the distance between the side member 203 and the guide member 216 is greater than in the opened position of use (FIG. 8). For the complete engagement of the pin 218 into the guide groove of the associated side member 203, greater lateral protrusion of the pin 218 beyond the guide member 216 is therefore necessary in the transport position. In order to take this circumstance into account, the pins 218 are not fastened rigidly on the corresponding guide member 216 in the embodiment shown in FIGS. 8 and 9 as they were in the embodiment first described but, rather, each pin 218 is supported for displacement in longitudinal direction in the guide member 216. As a result of the longitudinally displaceable support of the pins 218 in the guide members 216 as well as separate pretensioned spring (not shown) which press the pin against the associated guide groove, the protrusion of the pin 218, which changes upon the spreading apart of the legs of the ladder and upon the collapsing of the ladder, adapts itself automatically to the requirements. Assurance is thus had that the pin 218 will definitely engage into the slide block inserted into the guide groove even if the distance between the guide member 216 and the side member 203 changes due to a swinging of the legs 201 and 202.

For reasons of simplicity in manufacture, plastic sleeves of identical length are provided in connection with each step at its two pivot connections with the side members 207 and the two pivot connections with the guide members 216. Due to the lateral spreading of the side members 203 the four equally long plastic sleeves 217 of the lowermost step 210 are of the greatest length. The four plastic sleeves 217 of the middle step 210' which are identical to each other are shorter. An even smaller length results for the plastic sleeves 217" of the uppermost step 210" which are of equal length. In addition to the four plastic sleeves 217" which rest against the step 210", two further plastic sleeves 217" of the same length are provided as spacers between the side members 207 and 203.

Due to the use of identical spacer sleeves for each step it is also possible to make the two bars or tubes by means of which each step is swingably attached to the side members 207 and the guide members 216 of the same length for each step, which also simplifies the manufacture of the ladder. When using plastic sleeves of identical length on each step both for the pivot connection with the side members 207 and with the guide members 216, the position of the guide members 216 relative to the side members 203 changes upon the spreading and collapsing of the legs 201, 202 in the manner which can be noted from FIGS. 8 and 9. In the position of use shown in FIG. 8 in which the guide members 216 assume their highest position in which their upper ends are higher than the upper ends of the side members 207, the distance between the guide members 216 and the side members 203 is least and the inner edge of the guide member 216 extends displaced somewhat outward from the inner edge of the side members 207. In the transport position shown in FIG. 4, the guide members 216, on the other hand, have the greatest distance from the side members 203 so that the inner edges of the guide members 216 are shifted inwards about the same distance from the inner edges of the side members 207.

What is claimed is:

1. A stepladder comprising a first leg and a second leg, a shaft around which said legs are pivotally mounted relative to each other in a region of their upper end, each of the first and second legs having a pair of side members, plate-shaped supports each pivotally connected to said side members of the first leg around a respective first axis, the plate-shaped supports having rear regions, respectively, respective guide members are parallel to the respective side members of the first leg, each of said plate-shaped supports are connected swingably at the respective rear regions of the respective plate-shaped support to the two guide members around a respective second axis, said first and second axes extend parallel to each other and to said shaft, the latter permitting pivotal spreading of the two legs, and said plate-shaped supports upon a maximum spreading of the legs form steps of a stair, said guide members being located behind the side members of the first leg and, in the maximum spreading position of the first and second legs, being spaced from the side members of the first leg, connecting means for connecting one of said guide members to one of the side members of the second leg and the other said guide member to the other said side member of the second leg, respectively, said connecting means each including an elongated groove and a pin means engaging into said groove, and means for displaceably guiding said pin means in a longitudinal direction of the groove, the pin means projecting laterally beyond one of connected members of the connected guide member and side member and the elongated groove extending in the longitudinal direction of the other connected member of the connected guide member and side member, and a range of displacement of the pin means in the groove being so limited that when the first and second legs move towards each other the pin means and the rear regions of the plate-shaped supports connected to the guide members are constrained to move towards a lower end of the stepladder, a locking device with a separate manually actuatable locking element for each of the two pin means, said locking element being movably supported on the connected member provided with the elongated groove and in the position of the maximum spreading of the two legs positively secures the pin means against movement in the elongated groove.

2. The stepladder according to claim 1, wherein said locking element is a lever means which is swingably supported on the connected member having the pin means, means comprising a pretensioned spring for biasing said lever means, said locking lever being manually movable against the force of said pretensioned spring out of a locking position into an unlocked position.

3. The stepladder according to claim 2, wherein the lever means is a double-armed lever swingably mounted on each of the two side members of the second leg and one arm of the lever is formed with a notch receiving the pin means in the locking position and extends towards the lower end of the side member while the other arm forms an actuating member and extends close to an upper end of the respective side member.

4. The stepladder according to claim 3, wherein the swingably mounted lever has a U-shaped cross-sectional profile which engages over the respective side member and a wedge-shaped end section and the notch in said one leg of said profile is arranged adjoining the wedge-shaped end section such that said pin means is engageably into the notch without manual actuation of the lever.

5. The stepladder according to claim 3, including spring means for opposing the movement of the two legs into the position of the maximum spreading as a result of their spring force.

6. The stepladder according to claim 3, wherein the spring means include a first spring associated with each said pin means for biasing said pin means to move within the elongated groove from the position corresponding to the maximum spreading position of the legs in a direction corresponding to the collapsing of the legs.

7. The stepladder according to claim 6, wherein a spring stop is arranged in the elongated groove above the pin means and the first spring is a coil compression spring arranged in the corresponding elongated groove between the pin means and the spring stop limiting the length of the groove towards the top of the stepladder and the length of the coil compression spring is so dimensioned that in the maximum spreading position of the legs said spring with its spring force biases the pin means.

8. The stepladder according to claim 7, including a slide block in each said elongated groove comforming to the shape of the groove and wherein each said elongated groove has a C profile on the inside of said side member of the second leg and that within each said groove the slide block is displaceably guided, the corresponding pin means being engageable into a respective said slide block and against the latter slide block the lower end of the corresponding compression coil spring presses in the maximum spreading position of the first and second legs.

9. The stepladder according to claim 8, wherein the C profile of the elongated grooves has a longitudinally extending opening and the diameter of the compression coil springs is greater than the longitudinally extending opening, the elongated grooves have an open end adapted for introduction of the compression coil springs, into said elongated grooves, means comprising a closure member for closing the upper end of said elongated grooves and for serving as an upper spring stop.

10. The stepladder according to claim 9, wherein the closure member has a bottom portion and each said compression coil spring is fastened to the bottom portion of an associated said closure member.

11. The stepladder according to claim 1, wherein said side members have an upper end section region and the first leg is provided with only two of said plate-shaped supports, the uppermost of the latter being swingably attached to preselected ones of said side members in the region of said upper end section region thereof, and the height of the completely collapsed ladder, measured in the longitudinal direction of the legs, is less than 55 cm with a difference in height of at least 20 cm between the floor surface on which the ladder stands and a tread surface of lower of the plate-shaped supports as well as between the treat surface of the lower plate-shaped support and a tread surface of the upper plate-shaped support.

12. The stepladder according to claim 11, having a maximum height in completely collapsed condition of 51 cm where the maximum height of step is 23 cm.

13. The stepladder according to claim 11, having a width equal to its height in completely collapsed condition.

14. The stepladder according to claim 11, wherein a shaft connects each of the plate-shaped supports to said side members of the first leg and the distance from the shaft connecting the corresponding plate-shaped support with the side members of the first leg to a front side of the plate-shaped support increases from the upper plate-shaped support to the lower plate-shaped support.

15. The stepladder according to claim 1, wherein the tread surfaces of the plate-shaped supports each has a rear edge and said tread surfaces lie in a common plane in the transport position of the stepladder in which the rear edge of the lower plate-shaped support lies alongside a lower end of the side members of the first leg and the rear edge of the upper plate-shaped support lies at a predetermined distance from a front edge of the lower plate-shaped support.

16. The stepladder according to claim 15, wherein said predetermined distance is greater than the thickness of a finger.

17. The stepladder according to claim 15, wherein the back side of the side members of the second leg defines a first plane and the common plane lies in the first plane, and the front side of the side members of the first leg defines a second plane and in the transport position the plate-shaped supports are located between the side members of said first leg and the guide members without projecting beyond the second plane.

18. The stepladder according to claim 11, wherein a double-armed lever is swingably supported on each of the two side members of the second leg, one arm of said lever being provided with a notch, said lever having a locking position wherein the notch receives the pin means, said notch extending towards a lower end of the side member while the other arm forms an actuating member and extends close to an upper end of the respective side member, and a spring arrangement is associated with each of the two pin means, said spring arrangement lying within the elongated groove and biasing the pin means to move from a position corresponding to the maximum spreading position of the legs in a direction corresponding to the collapsing of the legs.

19. The stepladder according to claim 1, wherein the first leg is provided with three of said plate-shaped supports and the height of the completely collapsed ladder measured in the longitudinal direction of the legs is less than 80 cm with a difference in height of at least 23 cm each between tread surfaces of two successive plate-shaped supports and between a floor surface on which the ladder stands as well as between the tread surface of a lowermost of said plate-shaped supports.

20. The stepladder according to claim 19, wherein preselected ones of said side members carry the plate-shaped supports and the plate-shaped supports have a projection in a forward direction beyond the side members which carry said supports, said projection being smallest at an uppermost of said supports and largest at the lowermost support.

21. The stepladder according to claim 19, wherein said elongated grooves are in said side members, the distance between the two side members having said elongated grooves increases from an upper end towards a lower end, and the pin means are supported for displacement in the longitudinal direction in the guide members.

22. The stepladder according to claim 20, wherein said elongated grooves are in said side members, the distance between the two side members having said elongated grooves increases from an upper end towards a lower end, and the guide members are displaced outwards from the plane of swing of the side member associated with said guide members in the maximum spreading position of the legs, said guide members are disposed inwards from the plane of swing of the associated side member in the completely collapsed position of the legs.

23. The stepladder according to claim 1, wherein said elongated grooves are in said side members, and said pin means are connected to said guide members.

24. The stepladder according to claim 1, wherein said shaft simultaneously constitutes said first axis of an uppermost of said plate-like supports.

* * * * *